United States Patent [19]

Miller

[11] 4,310,755

[45] Jan. 12, 1982

[54] ELECTRONIC POSTAGE METER RADIANT ENERGY DEVICE CIRCUIT

[75] Inventor: Roland G. Miller, New Milford, Conn.

[73] Assignee: Pitney Bowes Inc., Stamford, Conn.

[21] Appl. No.: 107,101

[22] Filed: Dec. 26, 1979

[51] Int. Cl.[3] ..... H01J 40/14

[52] U.S. Cl. ..... 250/214 R; 250/214 A

[58] Field of Search ..... 250/208, 209, 214 R, 250/214 A, 551; 330/59; 307/311

[56] References Cited

U.S. PATENT DOCUMENTS

| | | | |
|---|---|---|---|
| 3,622,801 | 11/1971 | Stone | 307/311 |
| 3,772,514 | 11/1973 | Sunderland | 250/208 |
| 3,813,540 | 5/1974 | Albrecht | 250/206 |
| 3,814,944 | 6/1974 | Berger | 250/214 R |
| 3,886,351 | 5/1975 | Williams | 250/214 R |

*Primary Examiner*—David C. Nelms

*Attorney, Agent, or Firm*—David E. Pitchenik; William D. Soltow, Jr.; Albert W. Scribner

[57] ABSTRACT

A radiant energy system includes an energy receiving member for receiving energy and for converting received energy into electrical signals. Current amplifying means are coupled to the radiant energy receiving member. Voltage comparator means are coupled to the current amplifying means to compare the voltage developed by the current amplifying means to a reference voltage. The comparator provides an output signal indicative of whether the voltage applied to the comparator input is sufficient to actuate the circuit. The output characteristics of the comparator can be selected to be consistent with TTL and data processing circuit drive requirements. The system is suitable for use wherein the radiant energy devices are employed as position indicators for moveable parts and or electrical isolation of postage meters.

19 Claims, 2 Drawing Figures

ELECTRONIC POSTAGE METER RADIANT ENERGY DEVICE CIRCUIT

FIELD OF THE INVENTION

The present invention relates to radiant energy device circuits and more particularly to electronic postage meter radiant energy device circuits.

BACKGROUND OF THE INVENTION

Electronic postage meters have been developed with circuitry for controlling various functions within the postage meter. Systems of this type have employed radiant energy devices to serve several functions such as for electrical isolation between circuits or for position indicators for moveable parts. Electrical isolation may be incorporated, for example, between the control circuits and accounting circuits of the meter which are housed in a secure tamper resistant enclosure. The electrical isolation enhances the security of the meter by electrically isolating the accounting circuit and its associated registers which store information representing funding for postage to be printed from other circuits which may be housed in separate less secure type enclosures. The radiant energy devices may also be employed as an optical coupler to provide information on the physical position of moveable components within the meter. The information is coupled to a microprocessor or other processing circuit to appropriately process the information.

Electronic postage meters employing radiant energy devices are disclosed in U.S. Pat. No. 3,978,457 entitled "MICROCOMPUTERIZED ELECTRONIC POSTAGE METER SYSTEMS" issued to Frank T. Check, Jr., Alton B. Eckert, Jr. and Joseph R. Warren and in pending U.S. patent application Ser. No. 63,359 for "ELECTRONIC POSTAGE METER HAVING NOISE-REJECTING INPUT/OUTPUT CHANNEL," filed Aug. 3, 1979 for Frank T. Check, Jr. and assigned to Pitney Bowes Inc. The radiant energy devices and their associated circuits disclosed in the patent and pending application operate satisfactorily for their intended purposes.

Since postage meters are utilized in various consumer locations where postage is to be printed, the meters are subject to a wide range of environmental conditions. Moreover, as registers in the postage meter store information representing funding of postage to be printed, improper operation or failure of the circuitry within the meter can result in a loss of funds to the user or to the postal authorities. Accordingly, reliable operation of the meter and its components with a minimum of servicing is extremely important, as is also the security of the meter against tampering. In circuits employing a radiant energy receiving member such as a phototransistor with the collector-emitter electrode, in series with a resistance, conflicting factors of voltage level and switching speed are encountered. The greater the resistance, the greater the voltage developed. However, with increases in resistance, the time required to discharge the interelectrode capacitance increases. This increases the switching time of the device. The increase in switching time as a function of increases of voltage level can pose operational problems when the radiant energy device circuits are employed in conjunction with TTL (transistor transistor logic) circuits or data processing circuits which have both switching time and voltage level requirements for proper and accurate operation.

One TTL and microprocessing system requires a voltage level and a switching speed requirement for proper operation of 1.4 volts for a low (which can be designated to represent a logical zero) and greater than 3.6 volts for a high (which can be designated to represent a logical one). The transition from either a low to a high or a high to a low must occur within 5 microseconds.

The problem of selecting a trade-off between the voltage level and switching speed is compounded because of the many parameters associated with radiant energy devices which may vary from device to device. As a result, each circuit incorporating such devices may have to be individually adjusted to achieve a particular compromise of switching time and voltage level. One parameter for light emitting diodes (LED) is the amount of radiant energy emitted for a given current flowing through the device. This parameter is a function, in part, of the physical construction of the device. Another parameter is the mechanical alignment of the radiant energy emitting member and the radiant energy receiving member. The alignment controls the amount of radiant energy impinging on the radiant energy receiving member. A slight misalignment of a few degrees can significantly affect the amount of received energy which in turn controls the current flow through the radiant energy receiving member. The amount of current which will be generated for a given amount of incident radiant energy also varies from device to device and, in part, is a function of the device construction. The beta, or current gain, for typical phototransistors may vary from 200 to 20 between devices.

The above factors are also compounded by external factors in the postage meter environment. This includes contamination of the radiant energy device with dirt or grease from the mechanical components of the meter which coat the radiant energy emitting or radiant energy receiving member. The coating reduces the amount of effective radiant energy transmitted and/or received and thus reduces the operating level of the device. The interelectrode capacitance between the collector and the emitter electrodes of a phototransistor will also vary from device to device. Moreover, the interelectrode capacitance, the collector-emitter electrode leakage current, and the beta of the phototransistor can all "age," that is, vary over time. These parameters may vary with aging in a direction which increases the interelectrode capacitance and the leakage current and which reduces the beta. If care is not taken, the aged radiant energy device may cause the switching time and voltage levels to be outside of the required operating range of the circuits incorporating the device. All of the above variable parameters narrow the number of radiant energy devices which are suitable for use in a particular circuit and thereby increases the cost of the component by requiring the use of only devices within a limited range of parameters.

Typical optical circuits are disclosed in U.S. Pat. Nos. 3,886,351 for "OPTICAL-ELECTRONIC INTERFACE CIRCUIT"; 3,813,540 for "CIRCUIT FOR MEASURING AND EVALUATING OPTICAL RADIATION"; 3,772,514 for "ISOLATION AMPLIFIER" and 3,622,801 for "POST GENERATOR HAVING ADJUSTABLE THRESHOLD LEVEL." These circuits include optical members (radiant energy receiving members) connected to amplifiers. These circuits encounter the problems noted above.

SUMMARY OF THE INVENTION

The present invention provides an improved radiant energy device circuit which will operate reliably with a wide range of device parameter values. The circuit operates within the proper voltage level and switching time ranges for processing circuits with radiant energy devices having a wide range of device parameter values. In particular, the circuit is especially suited for use in postage meters which are subject to the environmental factors noted above.

A radiant energy system embodying the present invention includes a radiant energy receiving member for receiving radiant energy and for converting received radiant energy into electrical signals. Current amplifying means are coupled to the radiant energy receiving member. Comparator means are coupled to the current amplifying means. The comparator means compares the voltage level developed by the current amplifying means to a reference voltage. The comparator means provides an output which is indicative of whether the voltage applied to the comparator input due to the current amplifying means is sufficient to actuate the circuit.

DESCRIPTION OF THE DRAWINGS

A complete understanding of the present invention may be obtained from the following detailed description thereof, when taken into conjunction with the accompanying drawings, in which.

DETAILED DESCRIPTION OF THE INVENTION

Figure 1:
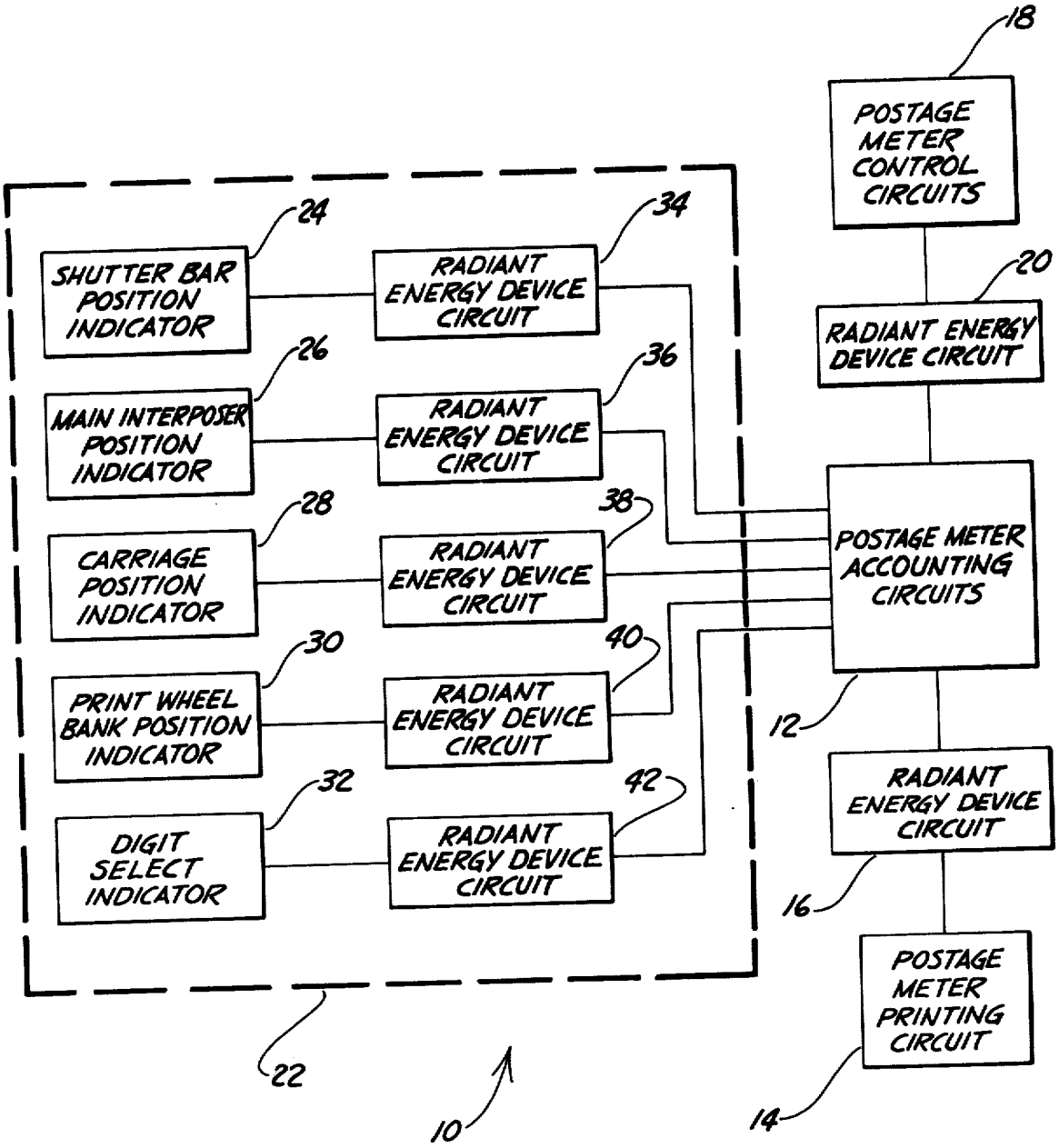
FIG. 1 is a diagrammatic block diagram of an electronic postage meter having a plurality of radiant energy device circuits of the type shown in FIG. 2.

Reference is now made to FIG. 1. An electronic postage meter 10 includes a postage meter accounting circuit 12 adapted to account for postage printed by the meter. The postage meter accounting circuits 12 are coupled to the postage meter printing circuit 14 by a radiant energy device circuit 16. The radiant energy device circuit 16 is of the type shown in FIG. 2 embodying the present invention. The postage meter printing circuits control the printing portion by the meter. The term postage meter is used to refer to the general category of devices for the imprinting a defined unit value for governmental or private carrier envelope or parcel delivery, or other like application for unit value printing. Thus, the term is used as a general term for devices utilized in conjunction with services other than those exclusively employed by governmental postal services. The term encompasses, for example, private parcel or freight service meters.

The postage meter accounting circuits 12 are connected to the postage meter control circuits 18 by a radiant energy device circuit 20. The radiant energy device circuit 20 is of the type shown in FIG. 2 embodying the present invention. The postage meter control circuit provides the circuitry for entering data and other information into the meter 10. Although not shown, the postage meter control circuits 18 and the postage meter printing circuit 14 may be interconnected to other portions of the meter for proper operation. One suitable arrangement is shown in pending U.S. patent application Ser. No. 089,413, filed Oct. 30, 1979, for John Henry Soderberg, Alton Brooks Eckert, and Robert Bruce McFiggans and entitled, "ELECTRONIC POSTAGE METER HAVING PLURAL COMPUTING SYSTEMS." The patent application is assigned to Pitney Bowes Inc. The disclosure of the patent application is incorporated herein by reference.

The mechanical portions of the postage meter, as diagrammatically shown, are enclosed in a separate housing 22. The printing mechanism include a shutter bar position indicator 24, a main interposer position indicator 26, a carriage position indicator 28, a print wheel bank position indicator 30 and a digit select indicator 32. Each of these mechanisms includes a mechanical moving part and an indicator. That is, a light emitting diode and a phototransistor are positioned so that moveable parts either block or temporarily interrupt the radiant energy from the light emitting diode from impinging upon the photosensitive base region of the phototransistor. Each of the various indicators 24, 26, 28, 30 and 32 are coupled respectively by radiant energy device circuits 34, 36, 38, 40 and 42 to the postage meter accounting circuits 12. It will be recognized that these radiant energy device circuits are of the type shown in FIG. 2 and embody the present invention. The printing portion of the circuit may be constructed as shown in pending U.S. patent application Ser. No. 089,412, filed Oct. 30, 1979, for Alton B. Eckert, Jr. Richard A. Mellon, Robert B. McFiggans, and Leonard M. Pengue and entitled, "PRINTING CONTROL SYSTEM." The patent application is assigned to Pitney Bowes Inc. The disclosure of the patent application is incorporated herein by reference.

While the various indicators 24 through 32 are used to provide information about the physical position of the printing portion of the meter 10, the radiant energy device circuits 16 and 20 are provided for electrical isolation the devices provide isolation between the postage meter accounting circuits 12 and the postage meter printing circuit 14 and also between the accounting circuit and postage meter control circuits 18. This allows the postage meter accounting circuits 12 to be housed in a more secure tamper resistant housing than other portions of the meter, should that be desired. This housing can be heavily shielded to prevent electromagnetic energy from entering the housing and possibly affecting operation of the circuts.

Figure 2:
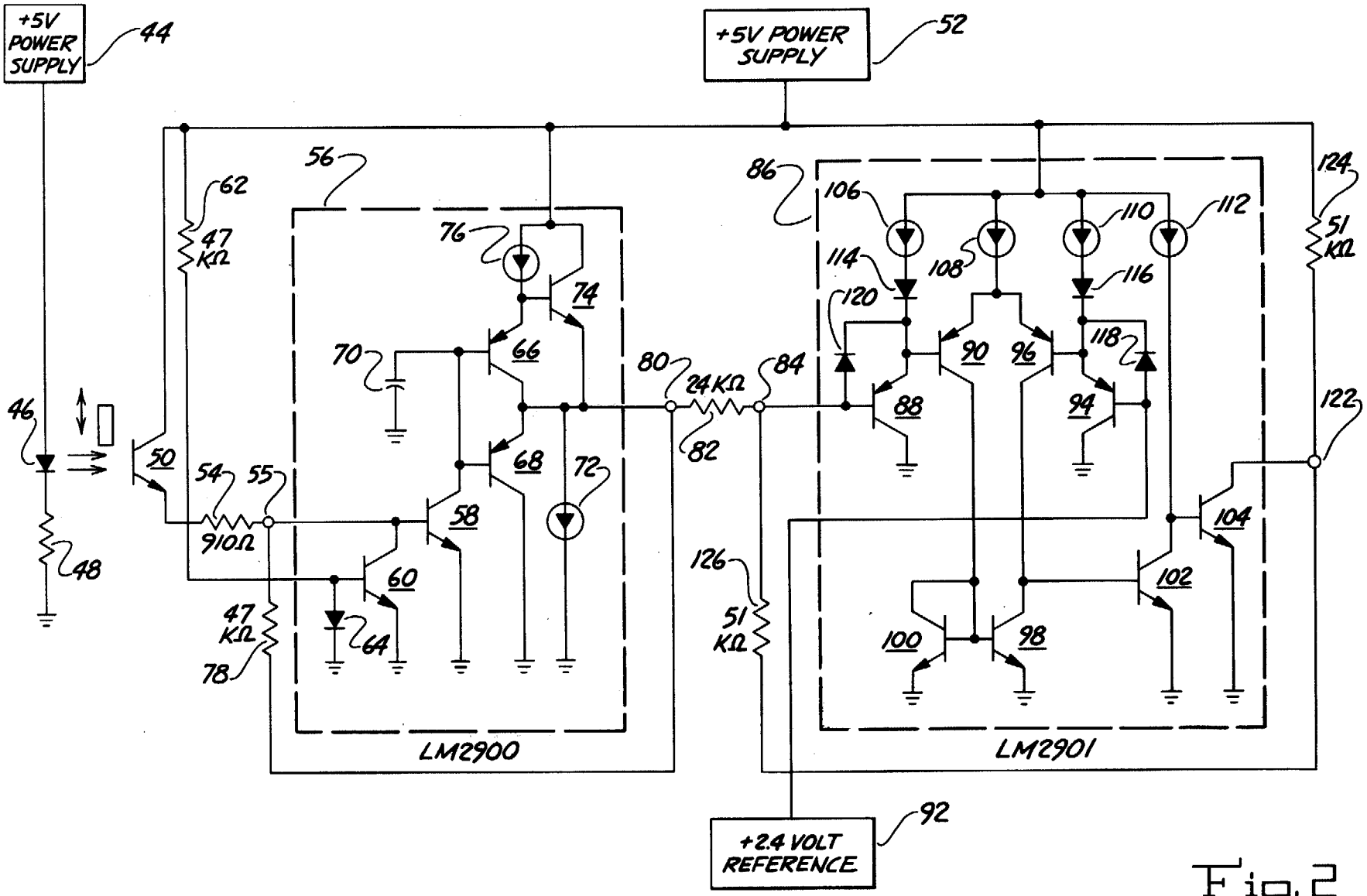
FIG. 2 is a radiant energy device circuit embodying the present invention.

Reference is now made to FIG. 2. A +5 volt in source 44 is connected to the anode of a LED 46. LED 46 is connected to ground through resistor 48. The flow of current through LED 46 causes the diode to emit radiant energy which impinges upon the photosensitive base region of a phototransistor 50. Phototransistor 50 has its collector electrode connected to a +5 volt source of operating potential 52 and its emitter electrode is directly connected by a resistor 54 to the input of a differential current amplifier 56. One suitable integrated circuit differential current amplifier is an LM 2900 manufactured by National Semiconductor Corporation. The differential current amplifier includes differential transistor pair input 58 and 60. The base electrode of a transistor 60 is connected by a resistor 62 to the +5 volt source of operating potential 52. A diode 64 is connected to the base electrode of the transistor 60 to protect the base emitter junction against excessive voltages. The inverted differential signal developed at the collector electrode of transistor 58 is applied to a symmetrical push-pull transistor amplifier pair 66 and 68. The base electrodes of the transistors 66 and 68 are both connected to the collector electrode of the transistor 58 and to ground via a capacitor 70. Capacitor 70 provides a high frequency bypass for transient signals which may damage the symmetrical push-pull amplifiers. The collector electrode of transistor 66 and the emitter electrode of transistor 68 are connected to a current source 72. The output at the emitter electrode of the transistor 66 is applied to an emitter follower output drive transistor 74.

The transistor 74 is operated from the +5 volt source of operating potential 52. Symmetrical push-pull transistor amplifiers 66 and 68 are connected via a current source 76 connected to the source of operating potential 52. A feedback resistor 78 is connected from the output terminal 80 of the differential current amplifier to the differential current amplifier input terminal 55. The feedback resistor establishes the current gain of the differential current amplifier at approximately 47000. The output of the differential current amplifier 56 is a voltage developed at the terminal 80. The voltage developed at the output terminal 80 increases linearly with increasing current input at terminal 55 until saturation is reached at approximately 4.5 volts.

The output of the differential current amplifier 56 is coupled via a resistor 82 to the input terminal 84 of a high speed voltage comparator 86. One suitable high speed comparator is LM 2901 type comparator manufactured by National Semiconductor Corporation. The high speed comparator 58 is operated from the +5 volt source of operating potential 52. The signal developed at the input terminal 84 of the high speed comparator is applied to the input of a darlington connected transistor pair 88 and 90. A +2.4 volt reference potential 92 is applied to a second darlington amplifier pair 94 and 96. The two darlington pairs are interconnected to form a differential amplifier. The collector electrodes of transistors 90 and 96 are connected to a drive transistor 98 and a transistor 100 interconnected to function as a diode to protect the drive transistor 98. The output developed at the collector electrode of the transistor 98 is applied to the base electrode of a transistor 102 which is connected in cascade with a second transistor 104. A plurality of current sources 106, 108, 110 and 112 are connected to the +5 volt source of operating potential 52 and provides a current source for operation of the individual transistors stages. Diodes 114 and 116 are included for protection of the current of sources 106 and 110. Clamping diodes 118 and 120 are respectively connected between the base electrode and emitter electrode transistor 94 and 88. These diodes protect the base emitter junction of transistors 94 and 88, respectively, from excessive voltage that may damage the transistors.

The output terminal 102 of the high speed comparator is connected by a resistor 124 to the +5 volt source of operating potential 52. The output terminal 122 is further connected to ground via the collector emitter current path of the transistor 104. Thus, when transistor 104 is biased into conduction, the output terminal 122 is at essentially ground potential (plus the collector emitter voltage drop of transistor 104). When the transistor 104 is biased out of conduction, the high speed comparator output terminal 122 is at approximately +5 volts. The voltage of the source 52 and the resistor 124 are selected to be compatible with selected TTL and microprocessing input/output drive levels. A feedback resistor 126 is connected between the output terminal 122 and the input terminal 84 of the high speed comparator. The resistor 126 provides a hysteresis function for the high speed comparator. Thus, in the quiescent state with no current flowing through the phototransistor 50 and a transistor 74 being biased out of conduction, current flows from the source of operating potential 52 through resistor 124, resistor 126, resistor 182 and diode 72 to ground. This develops a voltage of approximately 1.2 volts at the terminal 84 which must be overcome to activate the comparator 86. Only when a voltage is developed at terminal 84 (after being in a quiescent state) which exceeds the sum of the 1.2 volt quiescent level developed at terminal 56 and the 2.4 volt reference potential, will transistor 104 be biased from its non-conducting condition into its conducting condition. When this occurs, the terminal 122 is connected through transistor 104 to ground. The current flow from the source of operating potential 52 through resistor 124 and resistor 126 ceases. As a result, a lower voltage level is required at terminal 84 to keep transistor 104 biased into conduction, i.e. a lower level of input voltage is required to keep the output at terminal 122 low. This reduced voltage level is 2.4 volts, the reference voltage level. The hysteresis prevents voltage fluctuations at differential current amplifier output terminal 80 from causing oscillation in the high speed voltage comparator.

The considerations in selecting the appropriate feedback levels are important. This is because the current gain for the differential current amplifier 56 must be sufficiently large to eliminate the effects from variations due to the phototransistor and small enough to allow the high speed voltage comparator 86 the range necessary for the hysterisis to operate in, which, for the circuit components, is 3.6 to 2.4 volts. Moreover, the feedback resistance for the high speed comparator 86 must be sufficiently large to create the hysteresis levels required and still remain below the saturation voltage level of differential current amplifier 56.

What is claimed is:

1. A radiant energy system, comprising:

radiant energy receiving means for receiving radiant energy and converting received radiant energy into electrical signals;

current amplifying means coupled to said radiant energy receiving means;

voltage comparator means coupled to said current amplifying means and providing an output signal; and information processing means coupled to said voltage comparator means for processing the output signal information from said voltage comparator means.

2. A radiant energy system as defined in claim 1 wherein said current amplifying means has an output signal saturation level, and said voltage comparator means provides input signal hysterisis levels of operation, the current gain of said current amplifying means such that the output signal from said current amplifying means is within said voltage comparator means input signal hysterisis levels of operation and said voltage comparator means input hysterisis levels of operation is below said current amplifying means output signal saturation level.

3. A radiant energy system as defined in claim 1 wherein said current amplifying means is a differential current amplifying circuit.

4. A radiant energy system as defined in claim 1 wherein said radiant energy receiving means is a device having a leakage current flow during quiescent operation and the current amplifying means has a gain such that output signals from said current amplifying means due to said leakage current of said radiant energy receiving means are below the level which will actuate said voltage comparator means.

5. A radiant energy system as defined in claim 4 wherein said radiant energy receiving means is a phototransistor.

6. An energy system, comprising:

an energy receiving means for receiving energy and converting received energy into electrical signals;

a current amplifying means having an input terminal and an output terminal;

means for coupling said energy receiving means to said current amplifying means input terminal;

voltage comparator means having an input terminal and an output terminal;

first impedance means connected between said circuit amplifying means output terminal and said voltage comparator input terminal;

a first feedback impedance coupled between said current amplifying means input and output terminals; and a second feedback impedance coupled between said voltage comparator input and output terminals.

7. An energy system as defined in claim 6 further including data processing means connected to said voltage comparator output terminal.

8. An energy system as defined in claim 7 wherein said energy receiving means is a device having a leakage current flow during quiescent operation and the current amplifying means has a gain such that output signals from said current amplifying means due to said leakage current of said radiant energy receiving means are below level which will actuate said voltage comparator means.

9. An energy system as defined in claim 8 wherein said current amplifying means is an integrated circuit differential amplifier.

10. An energy system as defined in claim 9 wherein said voltage comparator is an integrated circuit voltage comparator of the type which compares a voltage developed at the input terminal to a reference voltage.

11. A postage meter, comprising:

a printing section for printing postage;

an accounting section for storing accounting information, an energy system coupled between said printing section and said accounting section and including:

(1) an energy receiving means for receiving energy and converting received energy into electrical signals;

(2) current amplifying means coupled to said energy receiving means; and (3) voltage comparator means coupled to said current amplifying means for providing output signals for said accounting section.

12. A postage meter as defined in claim 11 wherein said accounting section includes data processing circuits having a predetermined range of switching time and voltage level for proper operation, and said output signals from said voltage comparator means are within said predetermined range of switching time and voltage level.

13. A postage meter as defined in claim 11 wherein printing section for printing postage includes a moveable member; and said energy receiving means is a radiant energy receiving means and further including a radiant energy emitting member positioned so that emitted radiant energy will impinge on said radiant energy receiving means when said moveable member is in a first position and is block from impinging on said radiant energy receiving means when said moveable member is in a second position. and is block from impinging on said radiant energy receiving means when said moveable member is in a second position.

14. A postage meter as defined in claim 13 wherein said moveable member is a shutter bar position indicator.

15. A postage meter as defined in claim 13 wherein said moveable member is a main interposer position indicator.

16. A postage meter as defined in claim 13 wherein said moveable member is a carriage position indicator.

17. A postage meter as defined in claim 13 wherein said moveable member is a print wheel bank position indicator.

18. A postage meter as defined in claim 13 wherein said moveable member is a digit select indicator.

19. A postage meter as defined in claim 14, 15, 16, 17 or 18 wherein said accounting section includes data processing circuits having a predetermined range of switching time and voltage level for proper operation, and said output signal from said voltage comparator means are within said predetermined range of switching time and voltage level.

* * * * *